US007699761B1

(12) United States Patent
Dieter et al.

(10) Patent No.: US 7,699,761 B1
(45) Date of Patent: Apr. 20, 2010

(54) OVERSPEED TRAINER SYSTEM

(75) Inventors: William Dieter, Portland, OR (US); Patricia Eiting, Portland, OR (US); Polly James, Oconomowoc, WI (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/647,556

(22) Filed: Dec. 27, 2006

Related U.S. Application Data

(60) Provisional application No. 60/755,273, filed on Dec. 29, 2005.

(51) Int. Cl.
*A63B 21/02* (2006.01)
*A63B 71/00* (2006.01)
*A63B 21/002* (2006.01)
*A63K 3/00* (2006.01)

(52) U.S. Cl. ..... 482/124; 482/14; 482/74; 482/91

(58) Field of Classification Search ..... 482/14, 482/74, 124, 91, 122, 139, 906; 473/422, 473/424, 464; 434/253; 119/712, 769, 770, 119/772, 776, 778, 792, 795
See application file for complete search history.

(56) References Cited

U.S. PATENT DOCUMENTS 3,099,250 A * 7/1963 Soles, Jr ..... 119/776
3,519,269 A * 7/1970 Howlett et al. ..... 482/120
3,540,089 A * 11/1970 Franklin ..... 24/602
4,544,155 A * 10/1985 Wallenbrock et al. ..... 482/129
5,125,365 A * 6/1992 Bonilla ..... 119/776
5,167,601 A * 12/1992 Frappier ..... 482/121
RE34,351 E * 8/1993 Lacey ..... 119/776
5,803,881 A * 9/1998 Miller ..... 482/124
5,813,955 A * 9/1998 Gutkowski et al. ..... 482/124
5,951,443 A * 9/1999 Askins ..... 482/74
5,993,362 A * 11/1999 Ghobadi ..... 482/124
6,082,308 A * 7/2000 Walter ..... 119/769
6,374,779 B1 * 4/2002 Miller ..... 119/863
6,629,511 B2 * 10/2003 De Bien ..... 119/776

* cited by examiner

*Primary Examiner*—Loan H Thanh
*Assistant Examiner*—Allana Lewin
(74) *Attorney, Agent, or Firm*—Shook, Hardy & Bacon LLP

(57) ABSTRACT

A single-handed overspeed trainer system that detachably tethers an athlete to a trainer through a substantially quiet, non-hook and loop material, release structure is disclosed. In one embodiment, the athlete wears a belt with a substantially rigid loop extending therefrom. The trainer holds one end of a tether that contains a retractable pin toward its opposite end. The pin holds the rigid loop of the belt until the pin is retracted by the trainer, preferably when the tether's handle is released by the trainer.

16 Claims, 4 Drawing Sheets

OVERSPEED TRAINER SYSTEM

CROSS-REFERENCE TO RELATED APPLICATION

This application claims priority to U.S. provisional patent application Ser. No. 60/755,273, filed on Dec. 29, 2005.

FIELD OF THE INVENTION

The present invention relates to an overspeed trainer system for use primarily to detachably tether an athlete to a trainer.

BACKGROUND OF THE INVENTION

Overspeed trainers are used by athletes to improve their quickness and strength. Exemplar overspeed trainers can be found in U.S. Pat. No. 5,951,443 to Askins, and U.S. Pat. No. 5,803,881 to Miller, the disclosures of which are hereby incorporated by reference.

Despite the benefits offered by these known overspeed trainers, they have several drawbacks. For example, the person holding the tether must use both hands to activate their release mechanisms. Also, these known release mechanisms usually are quite noisy and frequently force the athlete to retain a "tail" portion of the tether. Such a tail is undesirable because it can catch on items or become entangled in the athlete's legs during training.

SUMMARY OF THE INVENTION

Accordingly, despite the available overspeed trainers, there remains a need for a single-handed overspeed trainer system that detachably tethers an athlete to another person.

The overspeed trainer of the present invention also includes a tether detachment structure that quietly activates, thereby preventing an athlete from using the sound of the releasing structure to anticipate release from the tether. Also, no "tail" portion remains with the athlete following detachment from the tether.

In addition to the other benefits disclosed herein, the present invention fulfills these needs.

DETAILED DESCRIPTION OF PREFERRED EMBODIMENTS

Figure 1A:
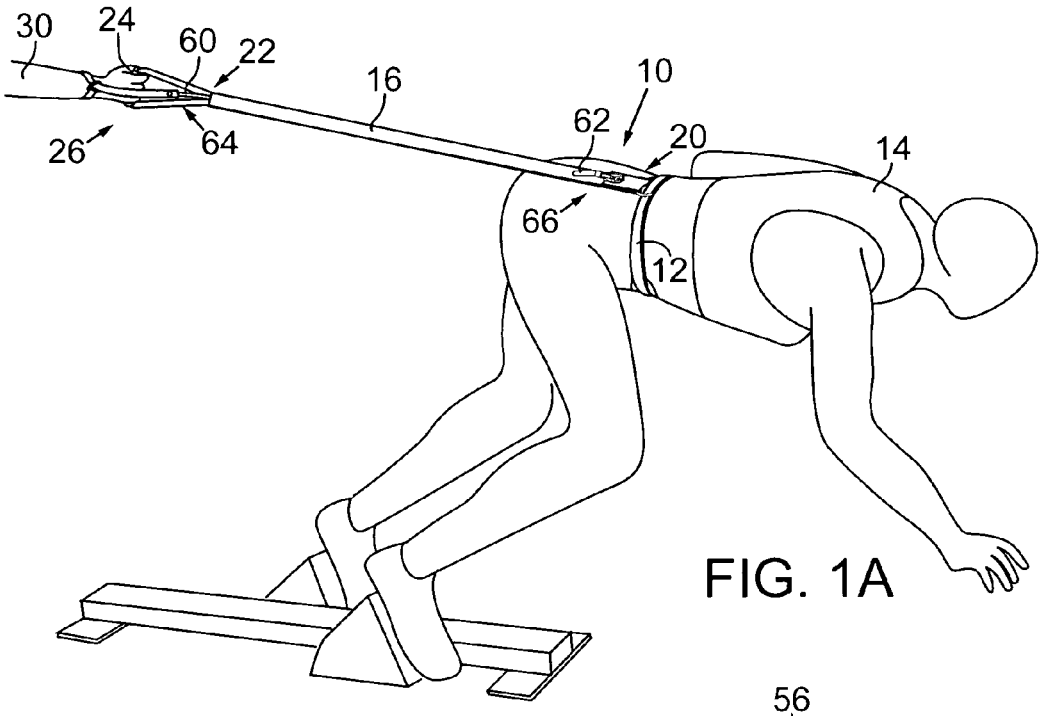
FIG. 1A is an isometric view of an overspeed trainer in accordance with an embodiment of the present invention showing a possible use configuration tethering an athlete to a trainer's hand.

An overspeed training system 10 is disclosed in FIGS. 1A-8. The overspeed training system 10 has an adjustable belt 12 that is worn by the athlete 14 and an elongate tether 16 is secured to the belt 12 at a first end 20 of the tether 16. The opposite second end 22 of the tether 16 preferably includes a handle 24. A release mechanism 26 operably secured to the tether 16 and belt 12, detachably secures the tether 16 to the belt 12.

A second person 30 holds the handle 24 while the athlete 14 pulls against the tether 16 as shown in FIG. 1A. During training exercises, the second person 30 activates the release mechanism 26 when the athlete 14 is pulling against the tether 16, thereby detaching the athlete 14 from the tether 16.

Figure 5:
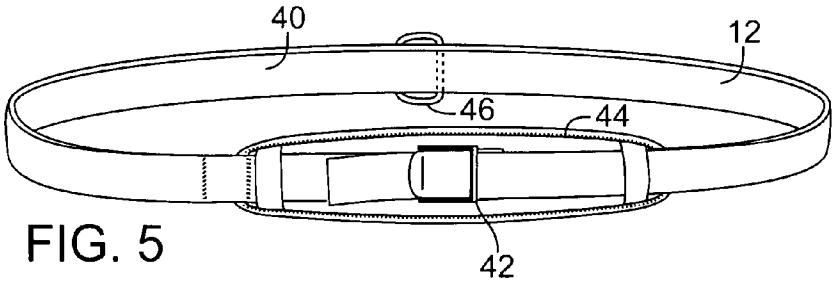
FIG. 5 is a front view of a belt portion forming a part of the overspeed trainer of FIG. 1.
Figure 6:
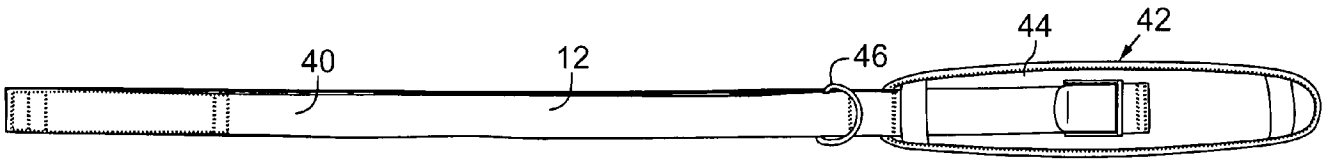
FIG. 6 is the belt portion in a possible disconnected-configuration.
Figure 7:
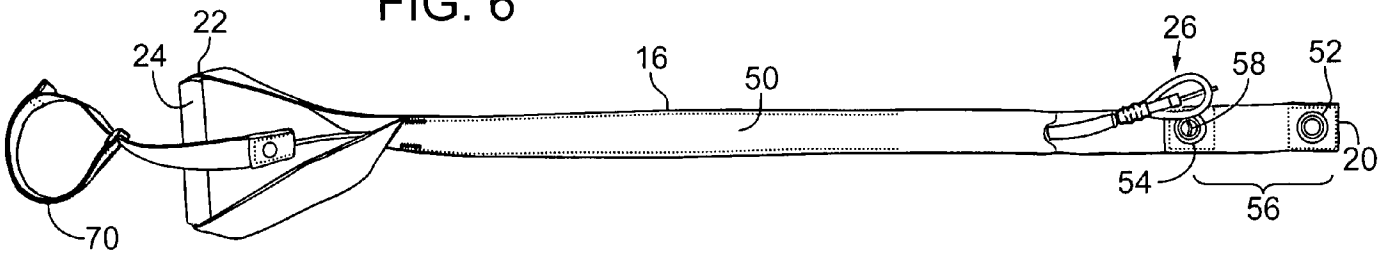
FIG. 7 is a top view of a tether portion forming a part of the overspeed trainer of FIG. 1.
Figure 8:
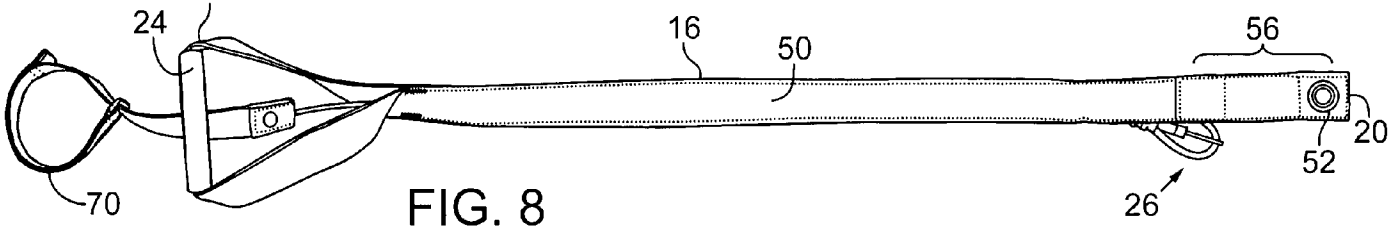
FIG. 8 is a back view of the tether portion of FIG. 7.

Referring to FIGS. 5 & 6, the belt 12 is preferably an elongate band of material 40 that is sized to encircle the athlete's waist. A belt buckle 42 is preferably provided to allow the size of the belt 12 to be adjusted on the athlete 14. More preferably, a pad 44 is operably secured to the belt 12 to improve the belt's comfort during use of the overspeed training system 10. A D-ring 46 is slidably secured to the belt 12 as shown.

Figure 2A:
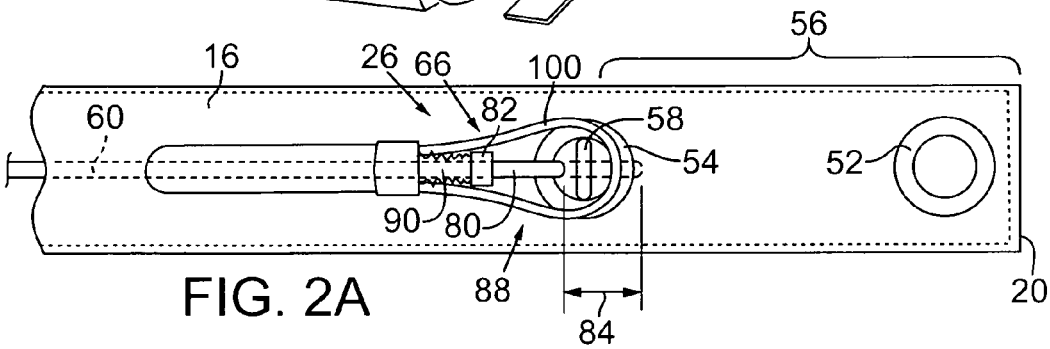
FIG. 2A is a partial top view of the overspeed trainer of FIG. 1 showing a release pin in a possible disengaged position.

The tether 16 preferably includes an elongate band of substantially flexible, but durable, material 50 such as woven material or the like. As best shown in FIG. 2A, a first grommet 52 is preferably positioned toward the first end 20 of the tether 16, and a second grommet 54 is spaced apart from the first grommet 52. Both grommets 52, 54 are substantially aligned along the longitudinal length of the tether 16, thereby defining a flap portion 56 of the tether 16, between the two grommets 52, 54. The second grommet 54 preferably includes a substantially rigid loop 58 extending substantially perpendicularly from the second grommet 54.

The release mechanism 26 is preferably a cable release as best shown in FIGS. 1A-2B. A cable 60 is slidably received within a cable housing 62, which is secured within the tether 16 as shown. One end of the cable is positioned substantially adjacent to the handle 24, thereby defining a handle-end 64 of the cable 60, and the opposite end of the cable 60 is positioned substantially adjacent to the second grommet 54 on the tether 16, thereby defining a grommet-end 66 of the cable 60.

A wrist strap 70 is preferably operably secured to the cable 60 at the handle-end 64 of the cable 60. The wrist strap 70 is preferably secured to the second person's wrist of the hand that is holding the handle 24 of the tether 16 as shown in FIG. 1A.

Figure 2B:
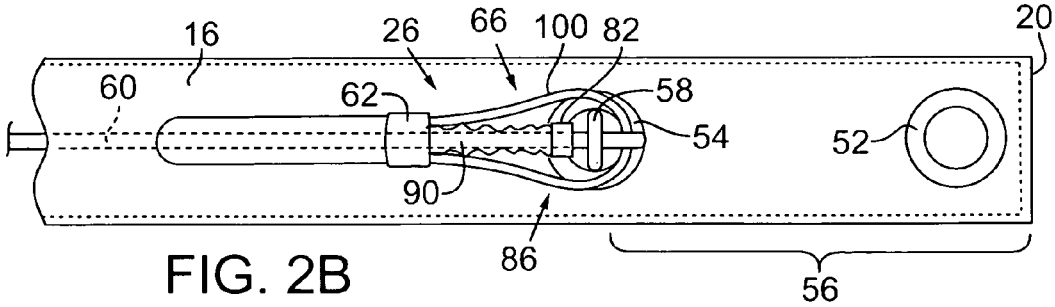
FIG. 2B is a partial top view of the overspeed trainer of FIG. 1 showing a release pin in a possible engaged position.

The grommet-end 66 of the cable 60 is sized and positioned so as to allow the distal end of the cable, which is referred to as a pin 80, to extend through the substantially rigid loop 58 as best showing FIGS. 2A & 2B. A ferrule 82 is secured to the cable 60 to limit the range of movement of the cable 60 to a defined distance 84 (FIG. 2A). This defined distance 84 includes an engaged position 86 (FIG. 2B) wherein the pin 80 extends through the substantially rigid loop 58, and a disengaged position 88, wherein the pin 80 is disengaged from the substantially rigid loop 58 as shown in FIG. 2A.

Preferably, a biasing member 90, such as a spring or other resilient member urges the pin toward the engaged position 86. More preferably, the biasing member 90 provides about 14 to 20 pounds of resistive force when compressed. Also, a protective loop 100 of resilient material preferably encircles the pin 80 as shown in FIGS. 2A & 2B. This protective loop 100 assists with holding the pin 80 in place through the substantially rigid loop 58, and prevents inadvertent contact with the pin when the tether is rapidly disconnected from the belt.

Figure 1B:
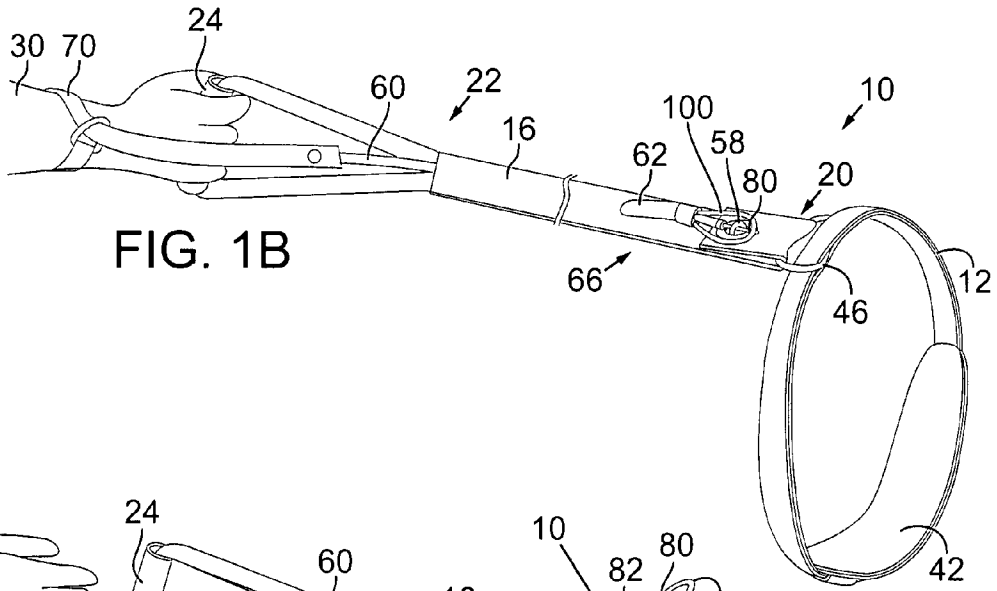
FIG. 1B is the overspeed trainer of FIG. 1 showing a possible connected configuration.
Figure 1C:
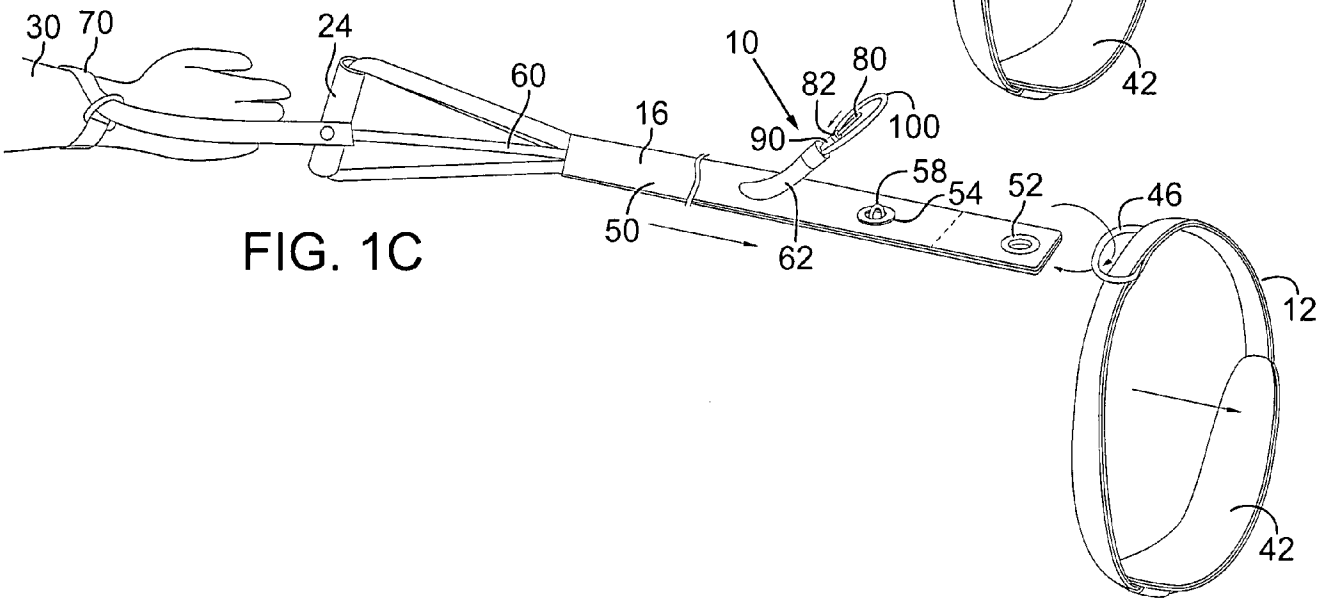
FIG. 1C is the overspeed trainer of FIG. 1 showing a possible disconnected configuration.
Figure 3:
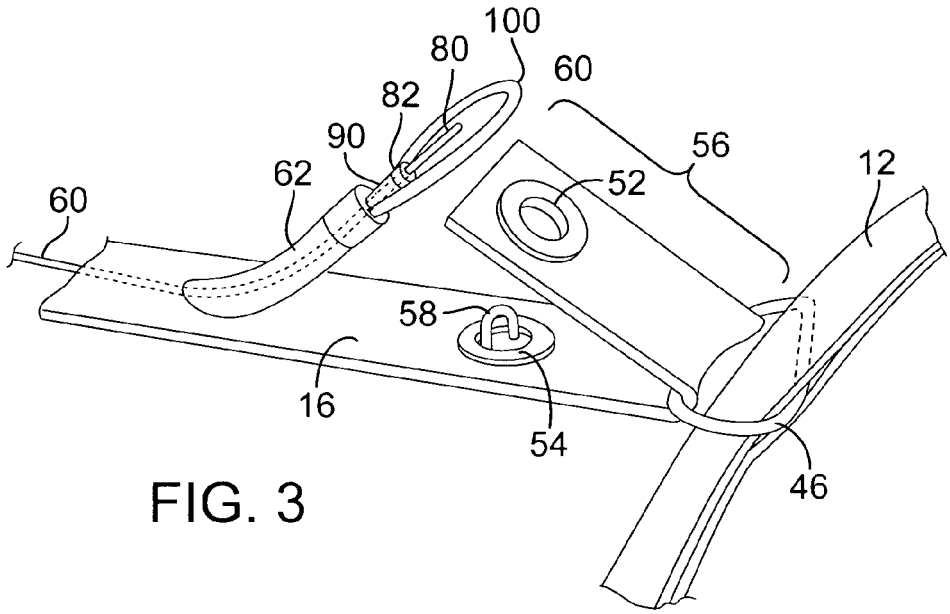
FIG. 3 is a partial isometric view of the overspeed trainer of FIG. 1 showing a possible disconnected configuration.
Figure 4:
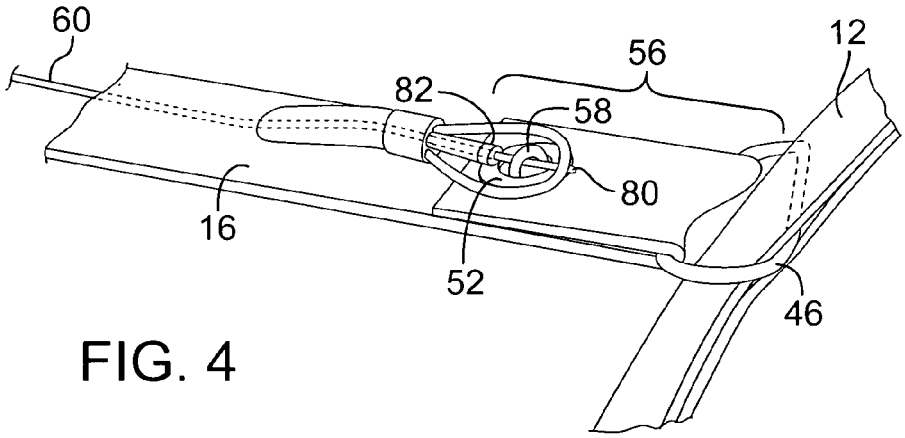
FIG. 4 is a partial isometric view of the overspeed trainer of FIG. 1 showing a possible connected configuration.

The athlete 14 is detachably secured to the tether 16 by sliding the first end 20 of the tether 16 through the D-Ring 46 on the belt 12 and aligning the two grommets 52, 54 on top of each other so that the substantially rigid loop 58 extends through both grommets 52, 54 as shown in FIG. 1B and the flap portion 56 of the tether 16 holds the D-ring 46. The pin 80 is then retracted and then released so as to position the pin 80 within the substantially rigid loop 58. The athlete is now tethered.

To release the athlete 14 from the tether 16, the second person initially grasps the handle 24 while the athlete 14 pulls the tether 16. With the wrist strap 70 encircling the second person's wrist, the second person simply lets go of the handle to release the athlete. Releasing the handle 24 causes the tension on cable 60 to increase thereby urging the pin 80 toward the disengaged position 88 (FIGS. 1A, 2C). When the pin 80 becomes disengaged from the substantially rigid loop 56, the first grommet 52 is released thereby opening the flap portion and releasing the D-Ring 46. This releases the athlete 14 from the tether 16.

Having described and illustrated the principles of our invention with reference to a preferred embodiment thereof, it will be apparent that the invention can be modified in arrangement and detail without departing from such principles. Accordingly, in view of the many possible embodiments to which the principles may be put, it should be recognized that the detailed embodiments are illustrative only and should not be taken as limiting the scope of our invention. Accordingly, we claim as our invention all such modifications as may come within the scope and spirit of the following claims and equivalents thereto.

We claim:

1. An overspeed training system for detachably tethering an athlete to one hand of a trainer, the overspeed training system comprising:

a belt worn by the athlete;

an elongate tether detachably secured to the belt toward one end, the elongate tether having a handle toward the opposite end, said handle grippable by the one hand of the trainer;

a release mechanism detachably connecting said elongate tether to said belt and an actuator; and a wrist strap for operably securing the actuator of the release mechanism to a wrist of the trainer, such that when the trainer releases the handle, the release mechanism detaches the elongated tether from the belt.

2. The overspeed training system of claim 1, wherein said release mechanism includes:

a movable pin secured toward said one end of said elongate tether;

a substantially rigid loop secured to said belt; and, said pin having an engaged position in which said substantially rigid loop is secured to said tether though said pin, and a disengaged position in which said substantially rigid loop is released from said elongate tether.

3. The overspeed training system of claim 2, further including a biasing structure for biasing said pin in said engaged position.

4. The overspeed training system of claim 2, further including a protective loop substantially encircling said pin.

5. The overspeed training system of claim 2, wherein a cable is operably secured within a sleeve formed within said elongate tether.

6. The overspeed training system of claim 2, further including a cable extending from said opposite end toward said one end of said elongate tether, said cable operably secured to said pin.

7. The overspeed training system of claim 1, wherein said releasing mechanism is hook-and-loop material free.

8. The overspeed training system of claim 1, wherein said release mechanism includes an activation cable extending from an engaging structure on the one end and the wrist strap on the opposite end, further including:

an engaging structure for operably receiving said cable toward said one end; and the actuator toward said opposite end for moving said cable.

9. An overspeed training system for detachably tethering an athlete to one hand of a trainer, the overspeed training system comprising:

a belt worn by the athlete;

an elongate tether detachably secured to the belt toward one end, the elongate tether having a handle toward the opposite end, said handle grippable by the one hand of the trainer;

a release mechanism detachably connecting said elongate tether to said belt, said release mechanism activated by the one hand of the trainer, said release mechanism having, an activation cable extending from said one end to said opposite end of the elongated tether, the activation cable having an engaging structure for operably receiving said cable toward said one end of the elongated tether and a cable activation structure toward said opposite end of the elongated tether for moving said cable; and a wrist strap for operably securing the cable activation structure to the trainer such that when the trainer releases the handle, the release mechanism is activated to allow detachment of the elongated tether from the belt.

10. The overspeed training system of claim 9, wherein said release mechanism is activated by the trainer releasing the one hand from said handle.

11. The overspeed training system of claim 9, further including a biasing structure for biasing said a release mechanism to hold said elongate tether to said belt.

12. The overspeed training system of claim 9, wherein said release mechanism is hook-and-loop material free.

13. An overspeed training system for detachably tethering an athlete to one hand of a trainer, the overspeed training system comprising:

a belt worn by the athlete;

an elongate tether detachably secured to the belt toward one end, the elongate tether having a handle toward the opposite end, said handle grippable by the one hand of the trainer;

a release mechanism detachably connecting said elongate tether to said belt, said release mechanism activated by the one hand of the trainer and having a movable pin secured toward said one end of said elongate tether;

a substantially rigid loop secured to said belt;

said pin having an engaged position in which said substantially rigid loop is secured to said tether through said pin, and a disengaged position in which said substantially rigid loop is released from said elongate tether;

a cable extending from said opposite end toward said one end of said elongate tether, said cable operably secured to said pin; and a wrist strap for operably securing the cable to the trainer such that the release mechanism is activated to allow detachment of the elongated tether from the belt when the trainer releases the handle.

14. The overspeed training system of claim 13, wherein said release mechanism is activated by the trainer releasing the one hand from said handle.

15. The overspeed training system of claim 13, further including a biasing structure for biasing said pin in said engaged position.

16. The overspeed training system of claim 13, wherein said release mechanism is hook-and-loop material free.

* * * * *